US012168935B2

(12) United States Patent
Da Silva et al.

(10) Patent No.: US 12,168,935 B2
(45) Date of Patent: Dec. 17, 2024

(54) METHOD FOR MOUNTING AN ABRADABLE ELEMENT COMPRISING A CELLULAR STRUCTURE IN AN ANNULAR GROOVE OF A TURBOMACHINE MEMBER

(71) Applicant: SAFRAN AIRCRAFT ENGINES, Paris (FR)

(72) Inventors: Quentin Alexandre Da Silva, Moissy-Cramayel (FR); Bastien Gilbert Assouly, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 18/558,840

(22) PCT Filed: Apr. 14, 2022

(86) PCT No.: PCT/FR2022/050710
§ 371 (c)(1),
(2) Date: Nov. 3, 2023

(87) PCT Pub. No.: WO2022/234205
PCT Pub. Date: Nov. 10, 2022

(65) Prior Publication Data

US 2024/0240567 A1 Jul. 18, 2024

(30) Foreign Application Priority Data

May 4, 2021 (FR) ..... 2104675

(51) Int. Cl.
*F01D 11/12* (2006.01)

(52) U.S. Cl.
CPC ..... *F01D 11/127* (2013.01); *F01D 11/122* (2013.01)

(58) Field of Classification Search
CPC ..... F01D 11/127; F01D 11/12; F01D 11/08; F01D 11/00; F01D 11/122; F01D 11/001;
(Continued)

(56) References Cited

U.S. PATENT DOCUMENTS 6,832,890 B2 * 12/2004 Booth ..... F01D 5/20 415/173.1
8,943,689 B2 * 2/2015 Stiehler ..... F04D 29/644 29/889.22

(Continued)

OTHER PUBLICATIONS

International Search Report mailed Aug. 16, 2022, issued in corresponding International Application No. PCT /FR2022/050710, filed Apr. 14, 2022, 2 pages.

(Continued)

*Primary Examiner* — Lawrence Averick
(74) *Attorney, Agent, or Firm* — Christensen O'Connor Johnson Kindness PLLC

(57) ABSTRACT

A method for mounting an annular abradable element in an annular groove of a member of a turbomachine. The annular abradable element extends along an axis and includes a cellular structure, the groove opening out at the radially inner periphery of the member. The method includes the steps of stressing the abradable element in such a way as to deform it in a plane perpendicular to the axis of the non-deformed annular abradable element, with the aid of a device; positioning the deformed abradable element axially opposite the annular groove, inside the member; freeing the abradable element in such a way that it inserts itself into the groove and recovers its annular shape there.

10 Claims, 14 Drawing Sheets

(58) Field of Classification Search
CPC ..... F05D 2230/68; F05D 2230/60; F05D 2230/00; F05D 2230/80; F05D 2250/283; F05D 2250/28; F05D 2250/20; F05D 2300/501; F05D 2300/50; F05D 2300/00
See application file for complete search history.

(56) References Cited

U.S. PATENT DOCUMENTS

| | | | | |
|---|---|---|---|---|
| 9,273,611 | B2 * | 3/2016 | Bird | F01D 25/285 |
| 9,822,659 | B2 * | 11/2017 | Arikawa | F01D 11/127 |
| 10,113,447 | B2 * | 10/2018 | Read | F01D 11/125 |
| 11,215,070 | B2 * | 1/2022 | Urac | F01D 11/122 |
| 11,248,484 | B2 * | 2/2022 | Schlothauer | F01D 11/127 |
| 11,952,909 | B2 * | 4/2024 | De Agostini | F01D 9/042 |
| 2004/0013518 | A1 * | 1/2004 | Booth | F01D 5/20 415/173.4 |
| 2011/0265328 | A1 * | 11/2011 | Stiehler | F04D 29/644 29/889.22 |
| 2014/0356142 | A1 * | 12/2014 | Arikawa | F01D 11/127 415/173.4 |
| 2016/0025012 | A1 * | 1/2016 | Bird | F02C 7/28 29/889.1 |
| 2016/0169043 | A1 * | 6/2016 | Read | F01D 11/125 415/173.1 |
| 2016/0230582 | A1 * | 8/2016 | Schlothauer | F01D 11/12 |
| 2021/0180467 | A1 * | 6/2021 | Urac | F04D 29/685 |
| 2022/0170385 | A1 * | 6/2022 | De Agostini | B23P 15/006 |

OTHER PUBLICATIONS

Written Opinion of the International Searching Authority mailed Aug. 16, 2022, issued in corresponding International Application No. PCT /FR2022/050710, filed Apr. 14, 2022, 6 pages.

* cited by examiner

METHOD FOR MOUNTING AN ABRADABLE ELEMENT COMPRISING A CELLULAR STRUCTURE IN AN ANNULAR GROOVE OF A TURBOMACHINE MEMBER

TECHNICAL FIELD

The present description relates to a method for mounting an abradable element comprising a cellular structure in an annular groove of a turbomachine member.

PRIOR ART

FIG. 1 illustrates a turbomachine 1 of the prior art. This comprises, from upstream to downstream in the direction of gas flow, a fan 2, a low-pressure compressor 3, a high-pressure compressor 4, a combustion chamber 5, a high-pressure turbine 6, a low-pressure turbine 7 and a gas-exhaust pipe 8. The high-pressure compressor 4 and the low-pressure compressor 3 are respectively connected to a high-pressure turbine 6 and a low-pressure turbine 7 by a respective shaft 9 extending in the longitudinal direction X of the turbomachine 1.

Each compressor stage 3, 4 is formed by an upstream movable wheel comprising an annular row of movable vanes 10 inside an external annular casing 11 and a downstream rectifier comprising an annular row of vanes 12 fixed with respect to the external annular casing 11. Likewise, each turbine stage 6, 7 is formed by an upstream distributer comprising an annular row of vanes 12 fixed with respect to the external annular casing 11 and a downstream movable wheel comprising an annular row of movable vanes 10 inside the external annular casing 11.

Each annular row of movable vanes 10 or fixed vanes 12 comprises an internal platform 13 and an external platform 14 delimiting an annular duct for flow of gases through the compressor 3, 4 or the turbine 6, 7.

As shown in FIG. 2, in the case of a turbine 7, the radially outer face of the external platform 14 of each movable vane 10 comprises wipers 15 sealingly cooperating with an annular abradable element 16 mounted in an external ring 17. In particular, the external ring 17 includes a groove emerging radially inwards, wherein the abradable element 16 is mounted. The external ring 17 is carried by the external annular casing 11.

As shown in FIG. 3, in the case of a compressor 4, the radially inner face of the internal platform 13 of each annular row of fixed vanes 12 comprises an annular groove receiving an annular abradable element 16. The abradable element 16 sealingly cooperates with wipers 15 of the shaft 9 of the turbomachine 1.

The abradable element 16 generally comprises a cellular structure, also referred to as a honeycomb structure, wherein the wipers 15 enter because of the differential thermal expansions and mechanical deformations in operation. Following prolonged use, the abradable element 16 wears and then requires to be changed.

For this purpose, after the worn abradable element 16 is removed from the annular groove of one of the external rings 17 or from the internal platform 13 of one of the annular rows of fixed vanes 12, a new abradable element 16 having an annular shape is manually deformed to be inserted in the annular groove. The abradable element 16 is then next once again deformed manually to extend annually entirely inside the annular groove.

Nevertheless, such manual deformation of the abradable element is haphazard and has the drawback of damaging the cellular structure of the abradable element 16, in particular because of the low resistance of the cellular structure in a tangential direction of the abradable element, so that the abradable element 16 mounted in the annular groove is in the end not in accordance with the required specifications.

SUMMARY

The present invention aims to remedy this drawback, in a simple, reliable and inexpensive manner.

For this purpose, the invention relates to a method for mounting an annular abradable element in an annular groove of a member of a turbomachine, the annular abradable element extending along an axis and comprising a cellular structure, the groove emerging at the radially inner periphery of said member, the method including the steps of:

- constraining the abradable element so as to deform it in a plane perpendicular to the axis of the non-deformed annular abradable element, by means of a device,
- axially positioning the deformed abradable element facing the annular groove, inside the member,
- releasing the abradable element so that it is inserted in the groove and regains its annular shape therein.

The terms axial, radial and circumferential are defined in relation to the axis of the annular groove, which is coincident with the axis of the turbomachine.

Such a method, because of the deformation of the abradable element in a plane perpendicular to the axis of the non-deformed annular abradable element, makes it possible to apply a normal force, i.e. in the direction of extension of the cells, at every point on the abradable element, and thus makes it possible to avoid the phenomena of damage to said abradable element by crushing of the cells of said element. The method is moreover relatively easy and quick to implement, in addition to being reproducible.

The abradable element can be annularly closed around the axis. In particular, the abradable element can be axisymmetric around the axis. In particular also, the abradable element can be cylindrical of revolution along the axis. A cross section of the abradable element in a perpendicular cutting plane can have the form of a closed ring.

In a constrained and deformed position of the abradable element, it can have the shape of a bean. In other words, in a constrained and deformed position of the abradable element, it can have a deformed part in the form of an omega and a non-deformed rounded part.

Such a shape makes it possible to reduce the dimensions of the abradable element so as to enable said deformed abradable element to be inserted inside the member comprising the groove, while avoiding areas of bending having excessively small radii of curvature. In particular, in a constrained and deformed position, the abradable element can have a maximum radius of curvature smaller than a radius of the groove of the member, enabling it to be inserted in the groove without forcing. Furthermore, such a bean shape makes it possible to avoid an excessively small radius of curvature that would risk causing a crushing of some cells and therefore damage to the abradable element. Moreover, such a bean shape is also compatible with a deformation of the annular element in one plane.

The device may comprise a first pressing member and a second pressing member both disposed on either side of a support base, each pressing member being connected to the support base by a linkage including a first end mounted so as to pivot with respect to the support base and a second end supporting the corresponding pressing member, the support base and the pressing members each including a curved lateral support surface, said lateral support surface of the support base coming into abutment on an external surface of the abradable element, said lateral support surfaces of the pressing members coming into abutment on an internal surface of the abradable element, the deformation of the abradable element being obtained by pivoting the linkages with respect to the support base and moving the linkages with respect to each other.

The shapes of the curved support bases make it possible to control the radii of curvature of the abradable element thus deformed.

The deformation of the abradable element can consist in winding the abradable element around the curved support surface of the support base, by moving the pressing members.

The curved support surfaces can be cylindrical in shape or be in the form of a portion of a cylinder.

The pressing members are for example formed by rollers. The support surface of the base may be a portion of a cylinder extending over an angular range greater than 120° for example. The support surface of the base may be semicylindrical.

The device may be symmetrical with respect to a symmetry plane passing through a center of the support base, the pressing members and the linkages being located on either side of said symmetry plane, the step aimed at constraining the abradable element being implemented by symmetrical movement of the pressing members and linkages with respect to said symmetry plane.

The symmetrical movement of the linkages makes it possible to avoid any rotation of the support base about the axis of the abradable element.

The forces to be applied to the pressing members to deform the abradable element around the base can then be equal.

Before deformation of the abradable element, the pressing members can be located on one side of a plane perpendicular to the symmetry plane and passing through the center of the support base and wherein, after the abradable element is deformed, the pressing members are located, at least partly, on the other side of said plane perpendicular to the symmetry plane.

Each pressing member can be mounted pivotably with respect to the second end of the corresponding linkage, each pressing member rolling on the internal surface of the abradable element when the linkages are moved with respect to the support base.

This thus avoids the pressing members rubbing on the internal face of the abradable element, so as to avoid any damage to the abradable element.

A gripping handle can be mounted on each linkage, said linkages being moved manually.

The device can include means for meshing (gearing) the linkages with each other, said meshing means (or gearing means) ensuring the symmetrical movement of said linkages with respect to a symmetry plane passing through the support base.

The first end of each linkage can include a toothed part meshing with the toothed part of the opposite linkage, the movement of one of the linkages causing the movement of the other linkage.

The device can include stop means able to limit the movement of the pressing members and linkages during the deformation of the abradable element.

The stop means make it possible to avoid over-deformation of the abradable element, so as to avoid damage thereto and crushing of the cells.

Such a stop can be formed, for each linkage, by a member projecting from the base, for example a rod, the linkage being able to come into abutment on said projecting member.

Such a stop can be formed, for each linkage, by a lug extending laterally from the corresponding linkage, the lugs of each linkage being adapted to come into abutment against each other when the linkages are moved with respect to each other.

The device can comprise locking means able to immobilize each pressing member in position with respect to the support base.

The locking means thus make it possible to hold the abradable element in deformed position after the pressing members are moved, so as to facilitate the implementation of the method, in particular when this method is implemented manually.

The locking means can include at least one ratchet wheel. Said ratchet wheel can include a cogwheel including teeth, secured to the base or respectively to one of the linkages, and a pawl, a part of which meshes with the teeth of the cog wheel, the pawl being mounted pivotably on one of the linkages, or respectively on the base, the meshing of the pawl with the cogwheel allowing rotation of the linkage with respect to the support base in one direction of rotation but preventing rotation of the linkage with respect to the support base in the opposite direction of rotation. The direction of rotation allowed corresponds to the movement of the linkages from the non-deformed position of the abradable element to the deformed position of the abradable element.

The pawl can be subjected to the action of an elastic return member tending to apply the meshing part of the pawl to the teeth of the cogwheel. The elastic return member may be a torsion spring.

The ratchet wheel can be able to be disengaged so as to prevent meshing of the pawl on the cogwheel, in particular when an operator wishes to move the linkages from the deformed position of the abradable element to the non-deformed position of said element. The pawl can include an actuation rod for manual disengagement of the ratchet wheel by an operator. In other words, an operator can separate the pawl from the teeth of the ratchet wheel by means of the actuation rod, counter to the return force exerted by the elastic return member, so as to disengage the ratchet wheel.

The teeth of the ratchet wheel can be conformed to allow disengagement of the ratchet wheel only after prestressing of the abradable element. Thus the return of the abradable element into the non-deformed position is protected.

One only or both linkages can be equipped with a ratchet wheel. Equipping each linkage with a ratchet wheel has the advantage of obliging and operated to have a hand on each handle when the abradable element is disengaged and returned into the non-deformed position, thus minimizing the risks of accidents and injuries.

The invention also relates to a device for implementing the method as described above.

BRIEF DESCRIPTION OF THE DRAWINGS

Other features, details and advantages will appear upon reading the detailed description hereinafter, and upon analyzing the appended drawings, wherein.

DESCRIPTION OF THE EMBODIMENTS

FIGS. 4 to 8 show a device 20 adapted for a method for mounting an abradable element 16 in an annular groove of a member 21 of a turbomachine 1.

Figure 1:
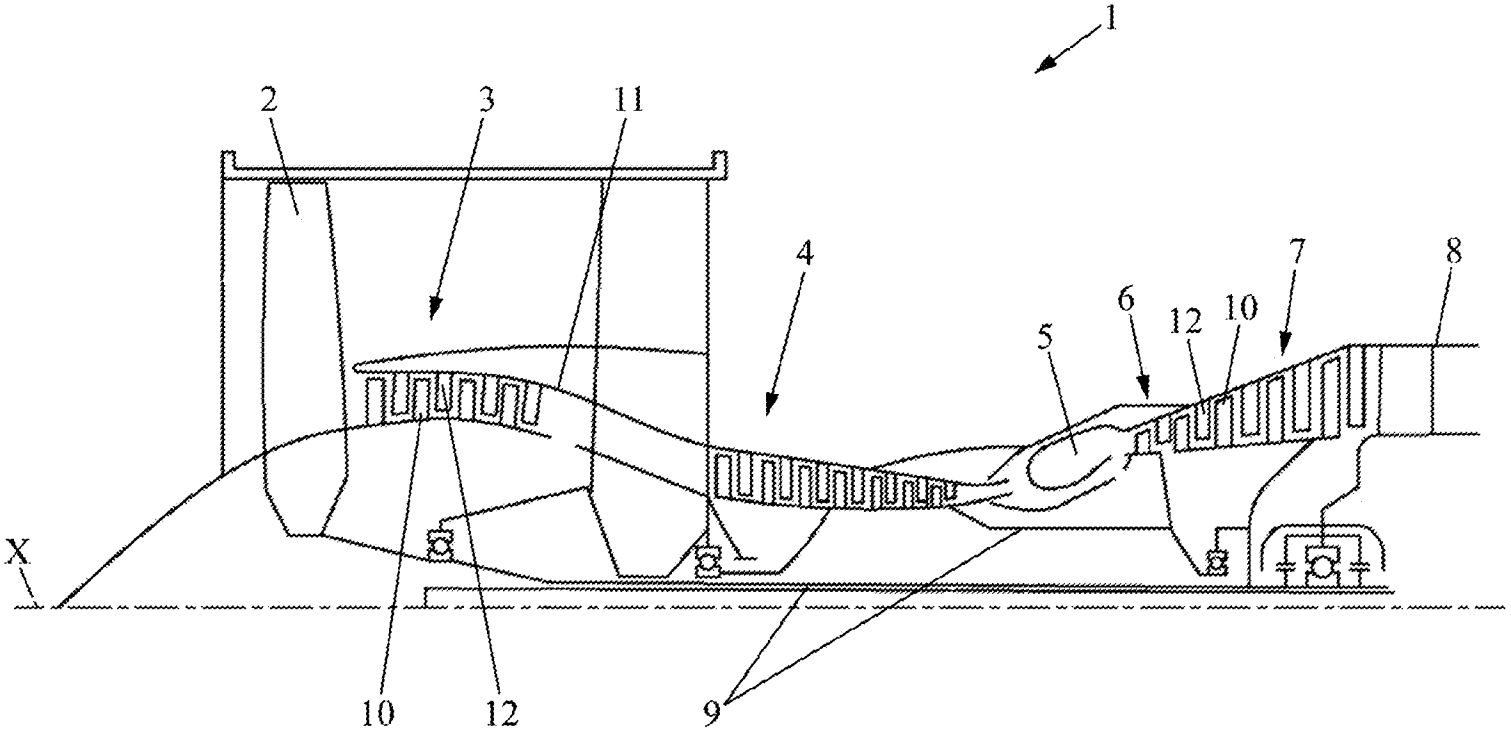
FIG. 1 is an axial sectional half-view of a turbomachine of the prior art.
Figure 2:
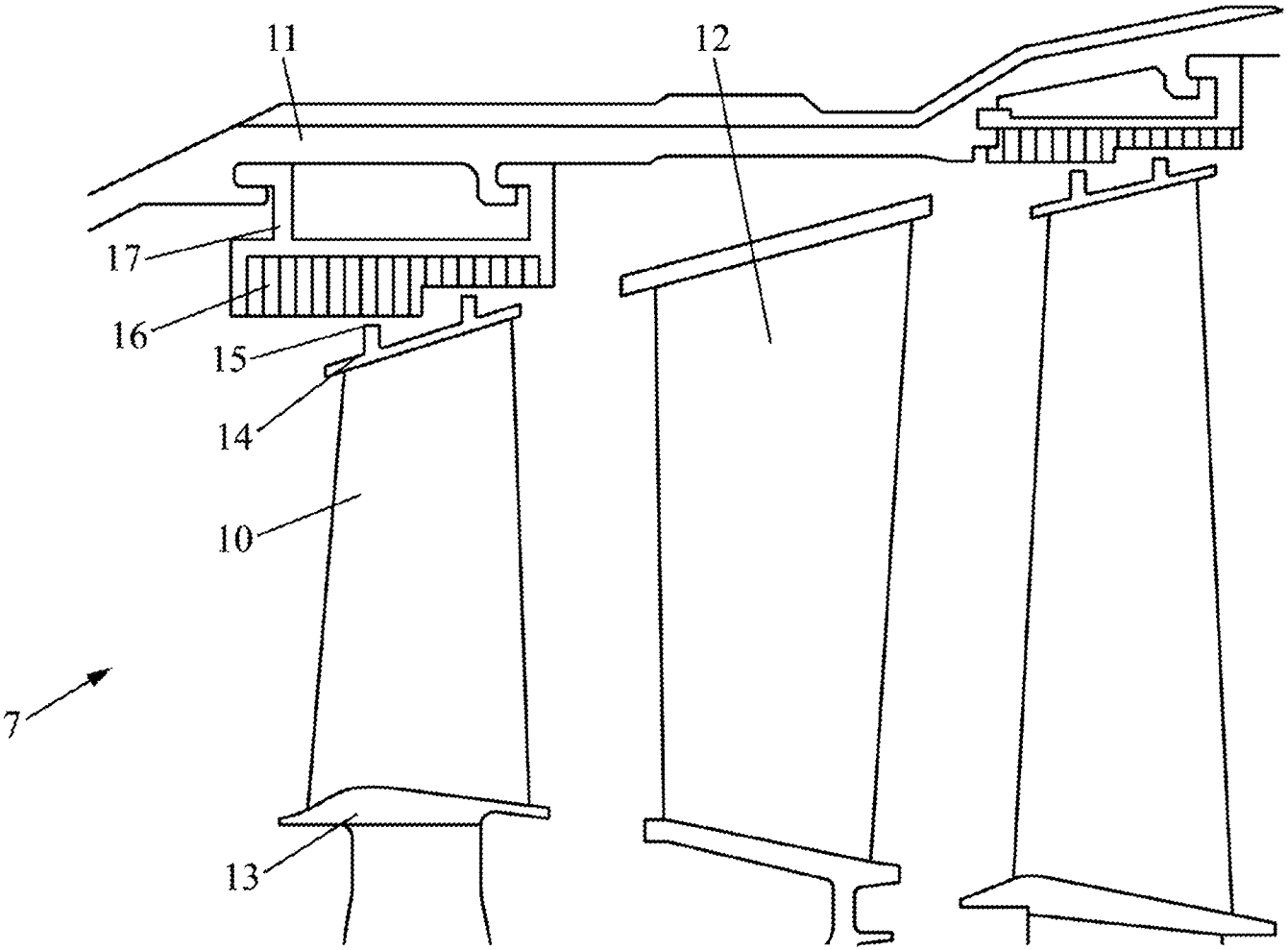
FIG. 2 is an axial sectional view of a portion of a turbine of the prior art.
Figure 3:
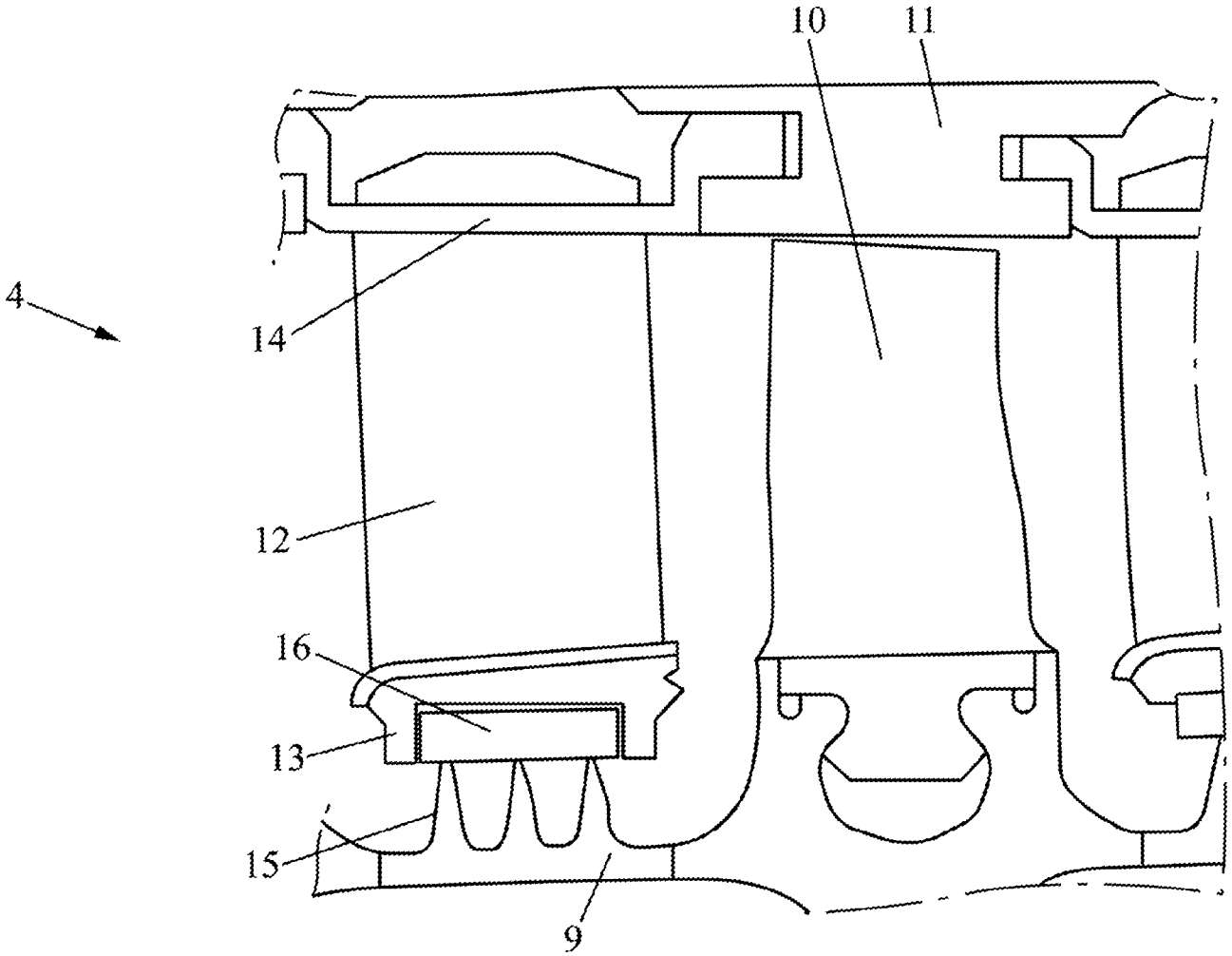
FIG. 3 is an axial sectional view of a portion of a compressor of the prior art.
Figure 4:
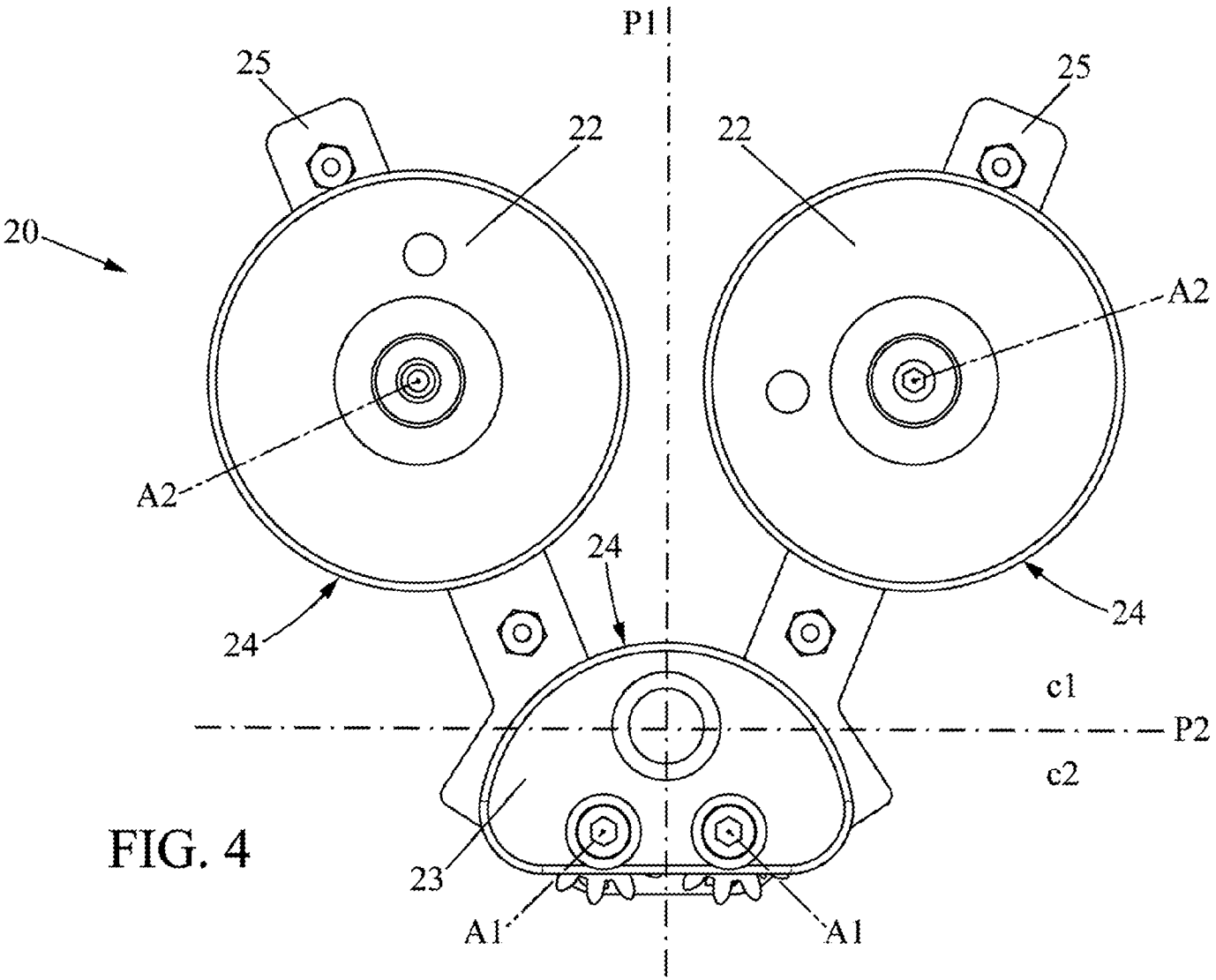
FIG. 4 is a front view of the device for implementing the method, in the non-deformed position of the abradable element.

As shown in FIG. 4, the device 20 comprises a first pressing member 22 and a second pressing member 22. The device 20 also comprises a support base 23. The first and second pressing members 22 are disposed on either side of the support base 23.

The support base 23 and the pressing members 22 each include a curved lateral support surface 24. The pressing members 22 are here each formed by a roller. The support surface 24 of the support base 23 is here a portion of a cylinder extending over approximately 180°. The base 23 moreover comprises a lateral surface opposite to the support surface 24. The opposite lateral surface is here planar.

Each pressing member 22 is connected to the support base 23 by a linkage 25 including a first end mounted so as to pivot about a first axis A1 with respect to the support base 23 and a second end supporting the corresponding pressing member 22. For this purpose, the first end of each linkage 25 is mounted on a first rod 26, formed for example by a screw, secured to the support base 23 and extending along the corresponding first axis A1.

The device 20 is symmetrical with respect to a symmetry plane P1 passing through a center of the support base 23. For this purpose, the pressing members 22 and the linkages 25 are located on either side of the symmetry plane P1.

Remarkably, each first axis A1, about which the corresponding link is 25 pivots, is parallel to the symmetry plane P1. Thus the pressing members 22 can be moved at least partly between a first side c1 of a plane P2 perpendicular to the symmetry plane P1 and passing through the center of the support base 23, and a second side c2 of the plane P2 perpendicular to the symmetry plane P1.

Each pressing member 22 is moreover mounted pivotally with respect to the second end of the corresponding linkage 25. Each pressing member 22 is in particular mounted so as to pivot about a corresponding second axis A2 of revolution. For this purpose, each pressing member 22 is mounted on a second rod 27 secured to the corresponding linkage 25 and extending along the second axis A2 of revolution of the corresponding pressing member 22.

Figure 5:
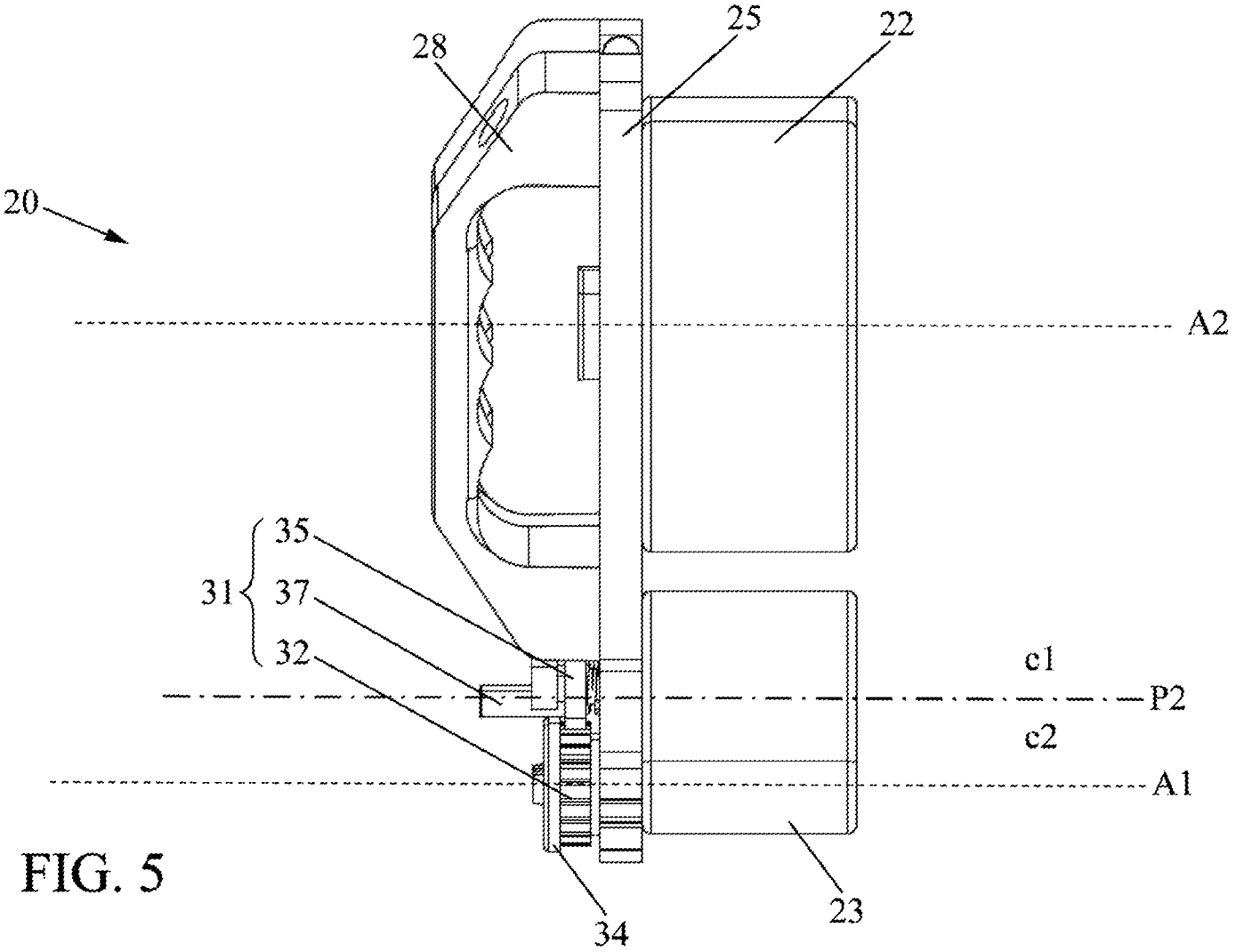
FIG. 5 is a side view of the device of FIG. 4.
Figure 6:
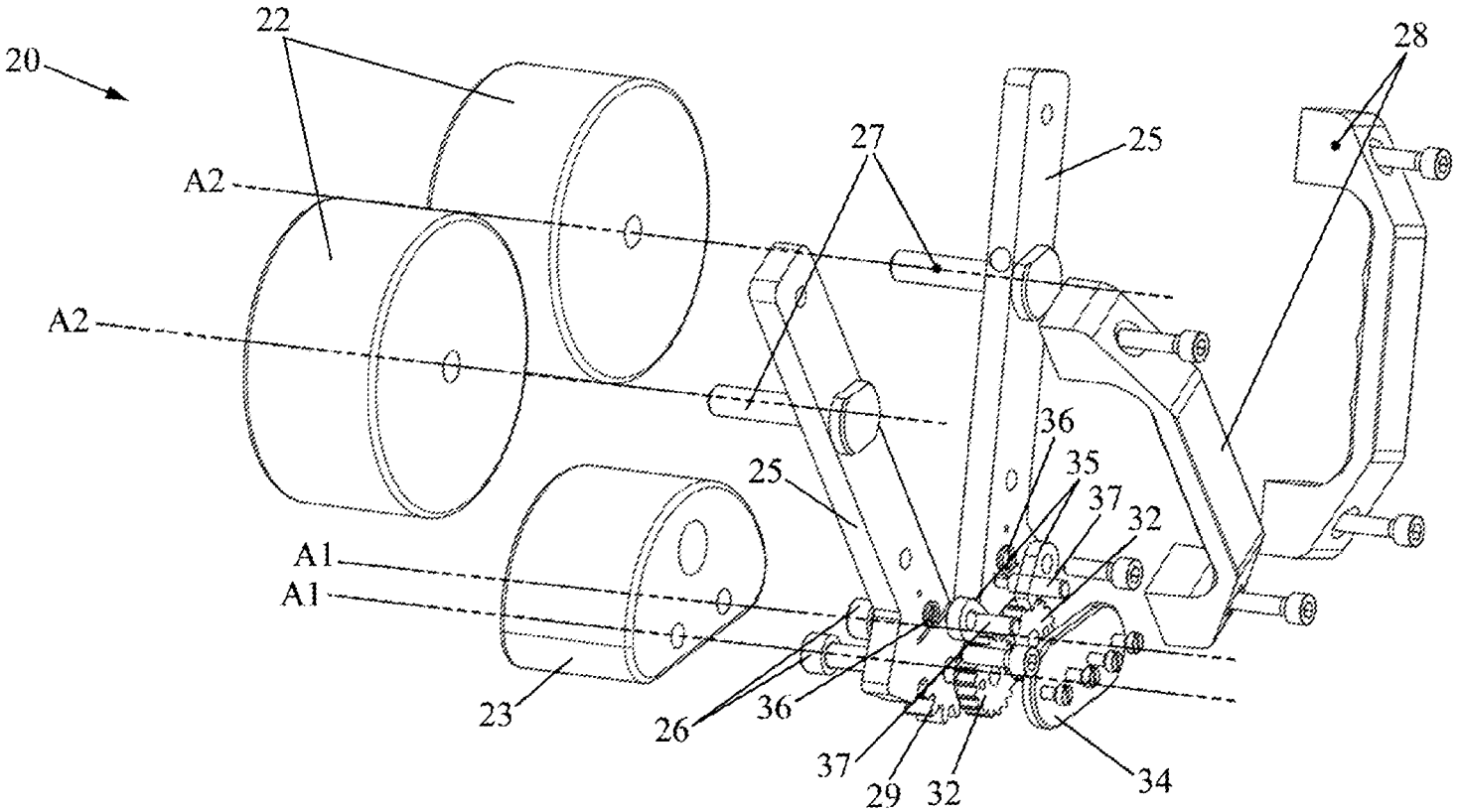
FIG. 6 is an exploded view, in perspective, of the device of FIGS. 4 and 5.
Figure 7:
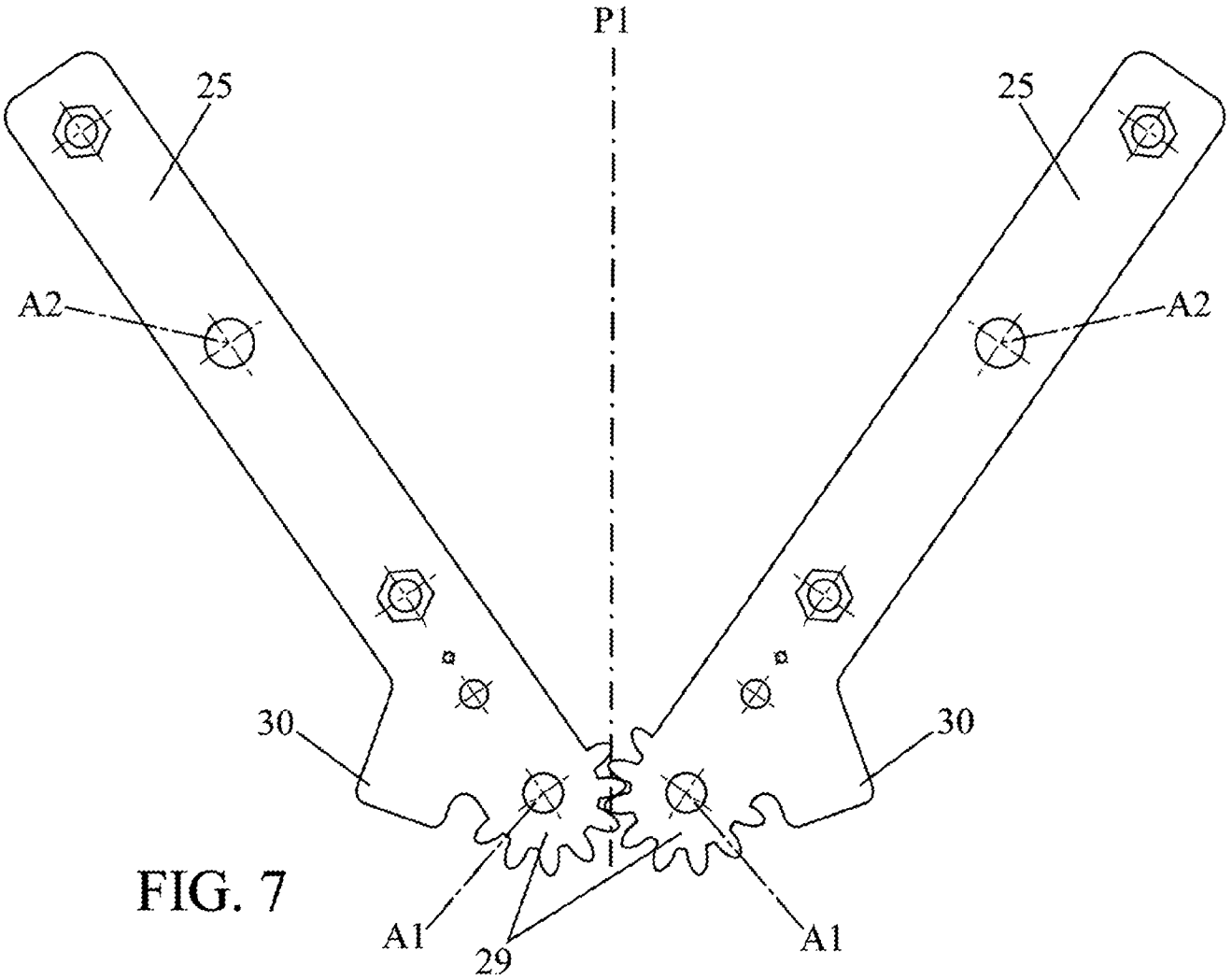
FIG. 7 is a view illustrating the meshing of the linkages of the device of FIGS. 4 to 6.

As shown in FIGS. 5 and 6, the device 20 furthermore comprises a gripping handle 28 mounted on each linkage 25. Each handle 28 is in particular mounted rigidly on the corresponding linkage 25. Here each handle 28 is screwed onto the corresponding linkage 25. Thus the linkages 25 can be pivoted manually with respect to the support base 23, by means of the handles 28.

The device 20 also includes means for meshing the linkages 25 with each other. The meshing means are more particularly visible in FIGS. 6 and 7. To do this, the first end of each linkage 25 can include a toothed part 29 meshing with the toothed part 29 of the opposite linkage 25. The teeth are disposed, at the first end of each linkage 25, in an arc of a circle around the first axis A1 of the corresponding linkage 25. In other words, the first end of each linkage 25 forms a toothed half-wheel. Thus symmetrical and simultaneous pivoting of the linkages 25 with respect to the symmetry plane P1 of the device 20 is provided.

The device 20 furthermore comprises stop means able to limit the movement of the pressing members 22 and linkages 25. Here the stops are each formed by a lug 30 extending laterally from one of the linkages 25. Thus the lugs 30 of the linkages 25 come into abutment against each other when the linkages 25 are pivoted from the first side c1 towards the second side c2 of the plane P2 perpendicular to the symmetry plane P1 of the device 20.

The device 20 also comprises locking means visible in FIG. 6. The locking means are able to immobilize each pressing member 22 in position with respect to the support base 23.

The locking means here include two ratchet wheels 31. Each ratchet wheel 31 comprises a cogwheel 32 including teeth 33. Each cogwheel 32 is here secured to the support base 23, in particular by means of one of the first rods 26. Each cogwheel 32 is thus centered on one of the first axes A1. The cogwheels 32 of the ratchet wheel 31 are also secured together by a plate 34, screwed into each of the cogwheels 32.

Figure 8C:
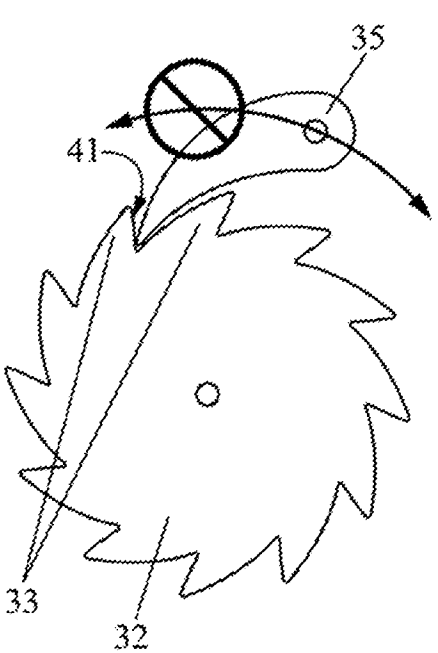
FIG. 8 comprises FIGS. 8*a*, 8*b*, and 8*c* illustrating the various successive positions of the pawl and cogwheel of the locking means of the device of FIGS. 4 to 6.
Figure 8B:
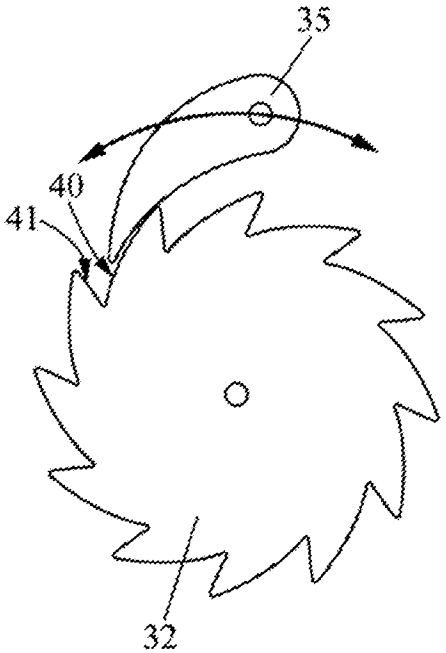
Figure 8A:
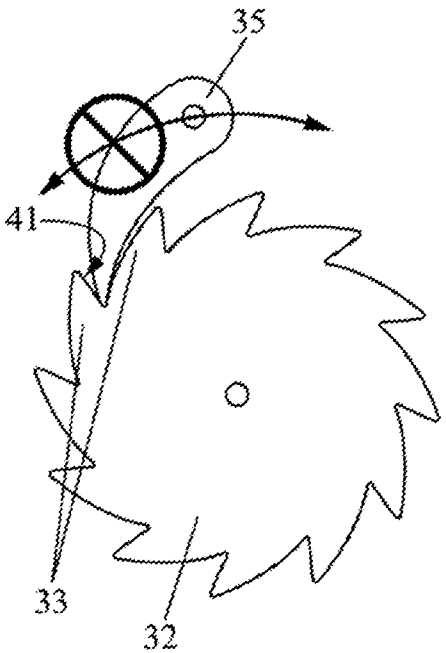

Each ratchet wheel 31 comprises a pawl 35, a part of which meshes with the teeth 33 of one of the cogwheels 32. Each pawl 35 is here mounted so as to pivot on one of the linkages 25. As shown in FIGS. 8*a*, 8*b* and 8*c*, the teeth 33 of each cogwheel 32 are uniform but asymmetric, each tooth 33 having a moderate slope 40 on one edge and a steep slope 41 on the other edge. Thus the meshing of the pawl 35 with the teeth 33 of the corresponding cogwheel 32 is such that it allows the pivoting, in one direction, of the linkage 25 carrying the pawl 35 and prevents the pivoting of the linkage 25 in the opposite direction of rotation. The direction of rotation allowed corresponds to the movement of the linkages 25 from the first side c1 of the plane P1 perpendicular to the symmetry plane P2 towards the second side c2 of the plane P2 perpendicular to the symmetry plane P1 of the device 20.

FIG. 8*a* shows the pawl 35 at the tooth bottom or at the steep slope 41 of one of the teeth 33. Thus a rotation of the linkage 25 carrying the pawl 35 in the opposite direction (anticlockwise direction on FIG. 8*a*) is prevented by the steep slope 41 of the tooth 33. Conversely, a rotation in the allowed direction (clockwise direction on FIG. 8*a*) is permitted by the sliding of the pawl 35 on the moderate slope 40 of the adjacent tooth 33. FIG. 8*b* shows the sliding of the pawl 35 on the moderate slope 40 of the tooth 33. FIG. 8*c* shows the pawl 35 once again at the tooth bottom and spaced apart from a tooth 33 compared with the position of the pawl in FIG. 8*a*. Likewise, a rotation of the pawl 25 in the opposite direction is prevented by the steep slope 41 of the tooth 33 whereas the rotation in the allowed direction is permitted by the sliding of the pawl 35 on the moderate slope 40 of the adjacent tooth 33.

Each pawl 35 is moreover subjected to the action of an elastic return member tending to apply the meshing part of the pawl 35 to the teeth 33 of the corresponding cogwheel 32. Each elastic return member is here a torsion spring 36. A first end of each torsion spring 36 is secured to one of the linkages 25. A second end of each torsion spring is in abutment on, or is secured to, the corresponding pawl 25.

Each torsion spring 36 can be constrained so as to prevent the meshing of the pawl 35 on the corresponding cogwheel 32. The corresponding ratchet wheel 31 is then disengaged so as to allow pivoting of the respective linkage 25 in the direction of rotation opposite to the direction of rotation allowed by the ratchet wheel 31. Each pawl 35 includes an actuation rod 37 for manual disengagement of the ratchet wheel 31.

FIGS. 9 to 14 show a method 100 for mounting an abradable element 16 in an annular groove of a member 21 of a turbomachine 1 by means of a device 20 in accordance with FIGS. 4 to 8. The member 21 of the turbomachine 1 can be an external ring 17 or an internal platform 13 belonging to a turbine 6, 7 or a compressor 3, 4, as is known from the prior art. The annular groove emerges at the radially internal periphery of the member 21 of the turbomachine 1.

The abradable element 16 is annular in shape and extends along a third axis A3. The abradable element 16 moreover comprises a cellular structure and is deformable.

Figure 9:
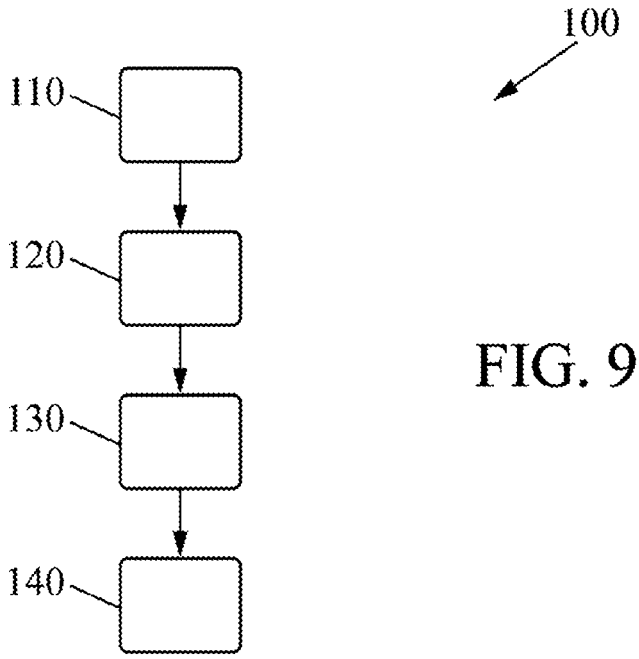
FIG. 9 is a functional diagram of the method for mounting an abradable element in an annular groove of a turbomachine, in accordance with the method according to the invention.

FIG. 9 shows a functional diagram of the mounting method 100.

Figure 10:
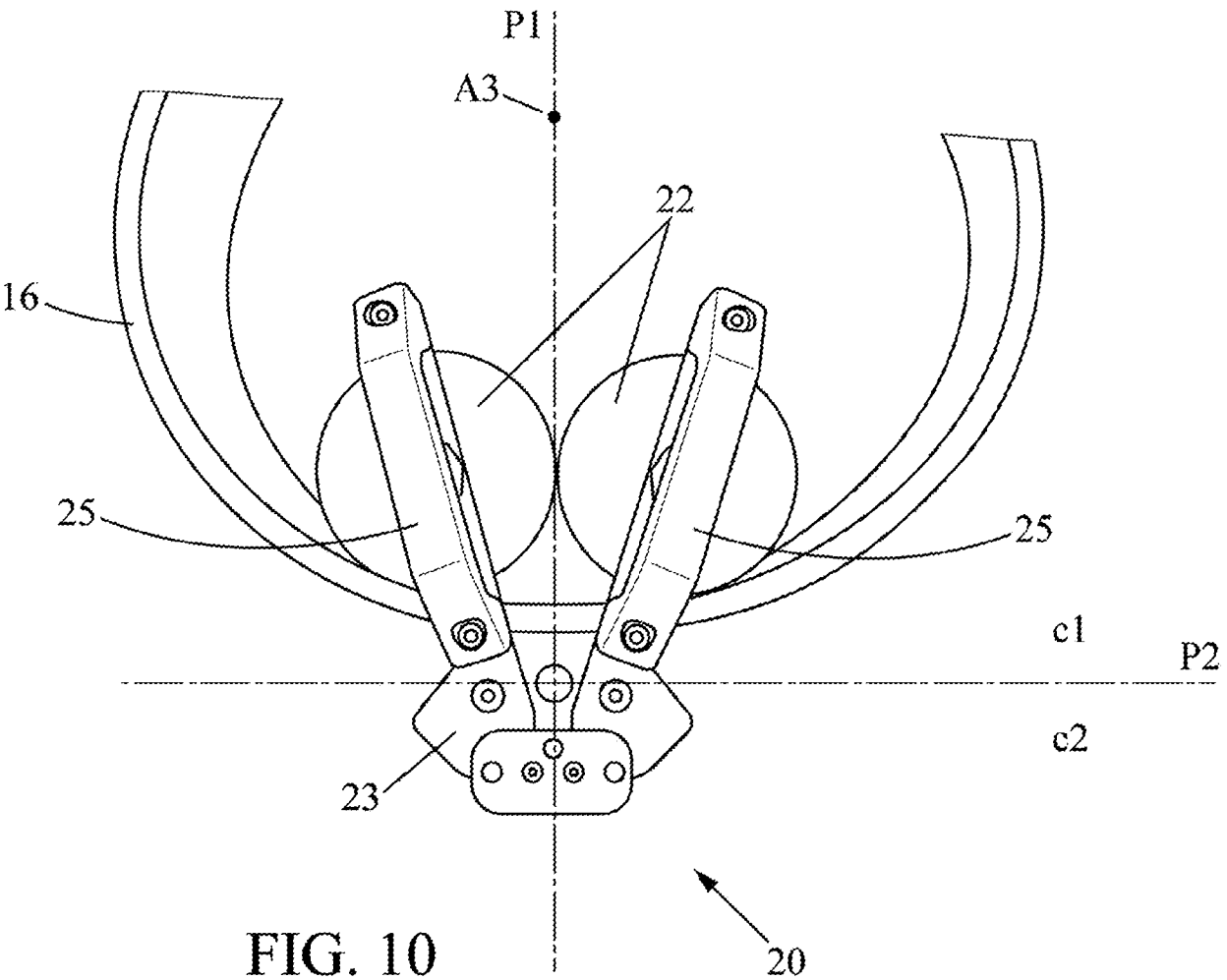
FIG. 10 is a front view illustrating the device of FIGS. 4 to 6 positioned on the non-deformed abradable element.

The mounting method 100 comprises a first step 110 shown in FIG. 10. The first step 110 consists in positioning the device 20 so as to bring the lateral support surface 24 of the base 23 into abutment on an external surface of the abradable element 16 and the lateral support surfaces 24 of the pressing members 22 into abutment on an internal surface of the abradable element 16. Remarkably, the pressing members 22 are located on the first side c1 of the plane P2 perpendicular to the symmetry plane P1 of the device 20.

Figure 11:
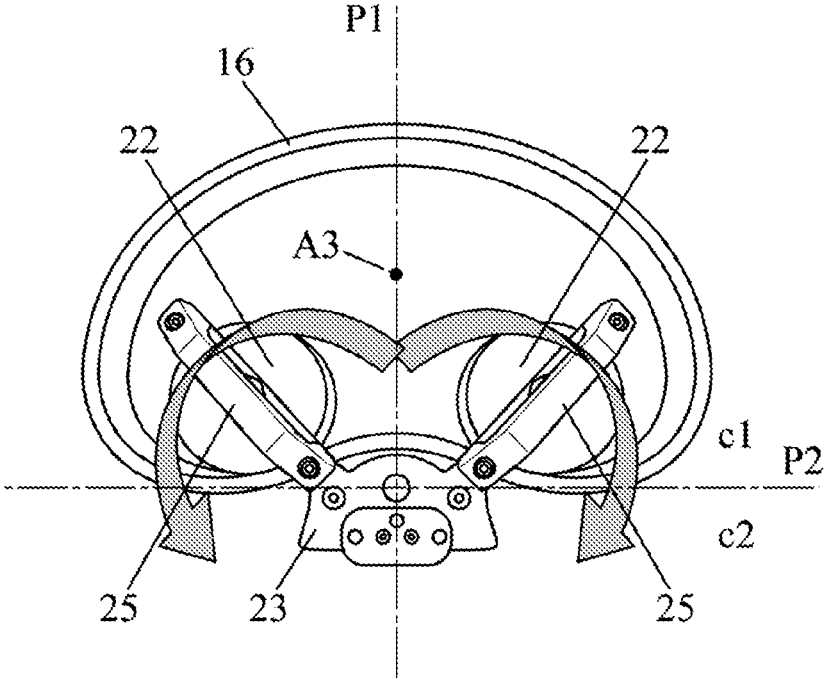
FIG. 11 is a front view illustrating a step of the method during which the abradable element is deformed.

As shown in FIG. 11, the method 100 comprises a second step 120 of constraining the abradable element 16 so as to deform it, at least partly, in a plane perpendicular to the third axis A3 of the non-deformed abradable element 16, by means of the device 20. To do this, the linkages 25 are pivoted with respect to each other so as to move the pressing members 22 towards the second side c2 of the plane P2 perpendicular to the symmetry plane P1. The linkages 25 are thus moved away from each other with respect to the symmetry plane P1 in a first phase of the movement. The linkages 25 are next moved closer to each other each other with respect to the symmetry plane P1 in a second phase of the movement. The linkages 25 are here moved manually, by means of the handles 28. Before the abradable element 16 is deformed, the pressing members 22 are located on the first side c1 of the plane P2 perpendicular to the symmetry plane P1 and, after the abradable element 16 is deformed, the pressing members 22 are here located on the second side c2 of the plane P2 perpendicular to the symmetry plane P1 of the device 20.

Thus the abradable element 16 is deformed so as to surround the curved support surface 24 of the support base 23.

Such a deformation in a plane perpendicular to the third axis A3 of the non-deformed abradable element 16 makes it possible to limit, or even avoid, crushing of the cells of the abradable element 16. Moreover, the shapes of the curved support surfaces 24 make it possible to control the radii of curvature of the abradable element 16 thus deformed. Thus the permitted rotation of the pressing members 22 about their respective second axis of revolution A2 enables the pressing members 22 to roll on the internal face of the abradable element 16 when the linkages 25 are moved with respect to the support base 23. This thus avoids the pressing members 22 rubbing on the internal face of the abradable element 16, so as to avoid any degradation of the abradable element 16.

Figure 12:
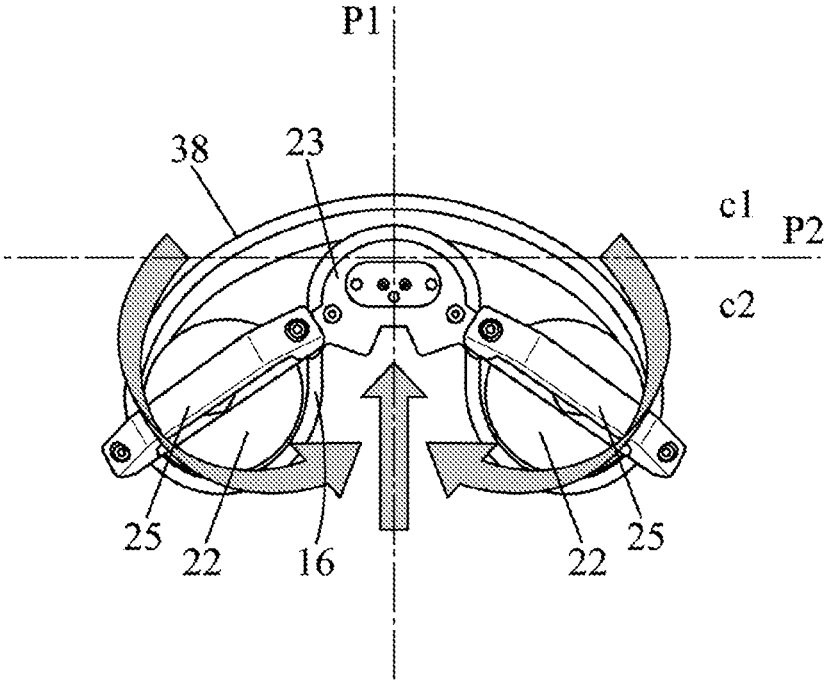
FIG. 12 is a front view illustrating the abradable element in a position constrained and deformed by the device of FIGS. 4 to 6.

The abradable element 16 is deformed to a constrained deformed position wherein the abradable element 16 has here the shape of a bean, as illustrated in FIG. 12. In other words, the abradable element 16 is partly deformed to have an omega (w) shape. The deformed abradable element therefore moreover comprises a non-deformed rounded part 38. Such a shape makes it possible to reduce the dimensions of the abradable element 16 so as to enable the deformed abradable element 16 to be inserted inside the member 21 of the turbomachine 1 comprising the annular groove. In addition, such a shape makes it possible to avoid areas of bending of the abradable element 16 the radii of curvature which are too small.

The constrained and deformed position of the abradable element 16 corresponds here to a position of the device 20 wherein the lugs 30 of the linkages 25 are in abutment against each other. The conformity of the deformation of the abradable element 16 is thus ensured. The method 100 is therefore easy to implement and is reproducible. Moreover, the stop means make it possible to limit the movement of the pressing members 22 and linkages 25 during the deformation of the abradable element 16. The stop means then make it possible to avoid over-deformation of the abradable element 16, so as to avoid damage thereto and crushing of the cells.

Moreover, the locking means of the device 20 here allow a rotation of the linkages 25 from the non-deformed position of the abradable element 16 to the deformed position of the abradable element 16. A rotation in the opposite direction is blocked by the ratchet wheels 31.

Thus, after the pressing members 22 are moved, the constrained and deformed position of the abradable element 16 is maintained by the locking means. This facilitates the handling of the abradable element in the constrained and deformed position, in particular when the method 100 is implemented manually.

Figure 13:
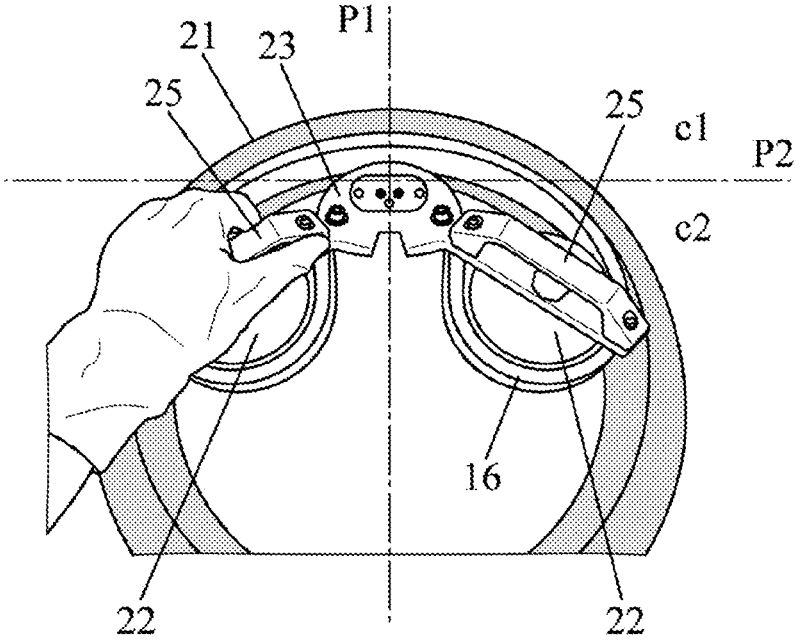
FIG. 13 is a view illustrating a step of the method wherein the deformed abradable element is positioned facing the annular groove of the turbomachine member.

As shown in FIG. 13, the method 100 comprises a third step 130 of axially positioning the abradable element 16 in the constrained and deformed position facing the annular groove, inside the member 21 of the turbomachine 1. The deformed abradable element 16 can be positioned so that the third axis A3 of the non-deformed abradable element 16 is coincident with a revolution axis of the annular groove of the member 21 of the turbomachine 1. Moreover, the abradable element 16 can be partly disposed inside the annular groove. The non-deformed rounded portion 38 of the deformed abradable element 16 can in particular be engaged inside the annular groove of the member 21 of the turbomachine 1.

Figure 14:
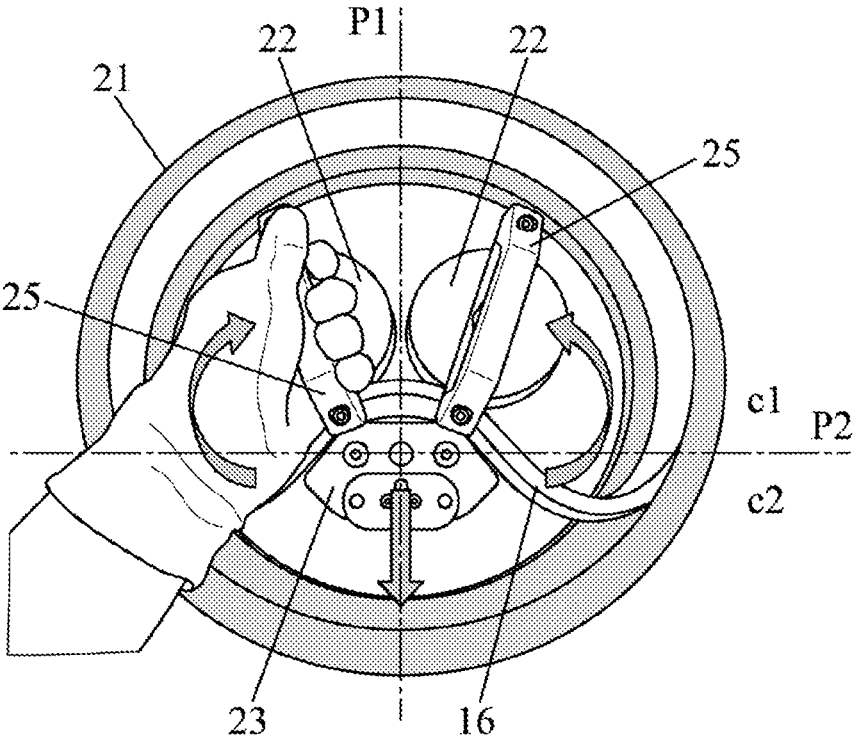
FIG. 14 is a front view illustrating a step of the method during which the abradable element is released to extend inside the annular groove.

The method 100 next comprises a fourth step 140 shown in FIG. 14. The fourth step 140 consists in releasing the abradable element 16 so that it is inserted in the groove and regains its annular shape therein.

To do this, each ratchet wheel 31 of the device 20 is disengaged by the operator by means of the corresponding rod 37, so that the operator can move the linkages 25 from the deformed position of the abradable element 16 to the non-deformed position of the abradable element 16.

In other words, an operator can separate the pawl 35 from the teeth 33 of the cogwheel 32 of each ratchet wheel 31 by means of the actuation rod 37, counter to the return force exerted by the elastic return member, so as to disengage the ratchet wheel 31. Next, the operator can move the linkages 25 to the non-deformed position of the abradable element 16 while maintaining the pawl 35 of each ratchet wheel 31 at a distance from the teeth 33 of the cogwheel 32.

The invention is not limited solely to the examples described above and is capable of numerous variants.

According to a variant that is not shown, the support base 23 can be secured to a support such as a table.

According to another variant that is not shown, the abradable element 16 can be deformed asymmetrically. For example, the linkages 25 can have an asymmetric movement with respect to the support base 23.

According to another variant that is not shown, the device 20 can comprise a motor drive that actuates the rotation of the linkages.

According to another variant that is not shown, the device 20 can comprise a support base 23 and rollers 22 having different profiles and/or sizes.

According to another variant that is not shown, the device 20 can comprise a system for reducing the force necessary for moving the pressing members 22 and linkages 25 with respect to the support base 23. Such a system can, for example, be a reduction gearbox.

The invention claimed is:

1. A method for mounting an annular abradable element in an annular groove of a member of a turbomachine, the annular abradable element extending along an axis and comprising a cellular structure, the groove emerging at the radially inner periphery of said member, the method comprising:

constraining the abradable element so as to deform it in a plane perpendicular to the axis of the non-deformed annular abradable element, by a device;

axially positioning the deformed abradable element facing the annular groove, inside the member; and releasing the abradable element so that it is inserted in the groove and regains its annular shape therein.

2. The method according to claim 1, wherein, in a constrained and deformed position of the abradable element, the abradable element has the shape of a bean.

3. The method according to claim 1, wherein the device comprises a first pressing member and a second pressing member both disposed on either side of a support base, each pressing member being connected to the support base by a linkage including a first end mounted so as to pivot with respect to the support base and a second end supporting the corresponding pressing member, the pressing members and the support base each including a curved lateral support surface, said lateral support surface of the support base coming into abutment on an external surface of the abradable element, said lateral support surfaces of the pressing members coming into abutment on an internal surface of the abradable element, the deformation of the abradable element being obtained by pivoting the linkages with respect to the support base and moving the linkages with respect to each other.

4. The method according to claim 3, wherein the curved support surfaces are cylindrical in shape or in the form of a portion of a cylinder.

5. The method according to claim 3, wherein the device is symmetrical with respect to a symmetry plane passing through a center of the support base, the pressing members and the linkages being located on either side of said symmetry plane, the step aimed at constraining the abradable element being implemented by symmetrical movement of the pressing members and linkages with respect to said symmetry plane.

6. The method according to claim 5, wherein, before the abradable element is deformed, the pressing members are located on one side of a plane perpendicular to the symmetry plane and passing through the center of the support base and wherein, after the abradable element is deformed, the pressing members are located, at least partly, on the other side of said plane perpendicular to the symmetry plane.

7. The method according to claim 3, each pressing member being mounted pivotably with respect to the second end of the corresponding linkage, each pressing member rolling on the internal surface of the abradable element when the linkages are moved with respect to the support base.

8. The method according to claim 3, wherein the device includes means for meshing the linkages with each other, said meshing means ensuring symmetrical movement of said linkages with respect to a symmetry plane passing through the support base.

9. The method according to claim 3, wherein the device includes a stop able to limit the movement of the pressing members and linkages during the deformation of the abradable element.

10. The method according to claim 3, wherein the device comprises locking means able to immobilize each pressing member in position with respect to the support base.

* * * * *